US011396639B2

(12) United States Patent
Prasad

(10) Patent No.: US 11,396,639 B2
(45) Date of Patent: Jul. 26, 2022

(54) ADDITIVE AND LUBRICANT FOR INDUSTRIAL LUBRICATION

(71) Applicant: Afton Chemical Corporation, Richmond, VA (US)

(72) Inventor: Ricky Shyam Prasad, London (GB)

(73) Assignee: Afton Chemical Corporation, Richmond, VA (US)

( * ) Notice: Subject to any disclaimer, the term of this patent is extended or adjusted under 35 U.S.C. 154(b) by 28 days.

(21) Appl. No.: 16/872,841

(22) Filed: May 12, 2020

(65) Prior Publication Data

US 2020/0362264 A1 Nov. 19, 2020

Related U.S. Application Data

(60) Provisional application No. 62/847,085, filed on May 13, 2019.

(51) Int. Cl.

| | |
|---|---|
| ***C10M 169/04*** | (2006.01) |
| ***C10M 129/70*** | (2006.01) |
| ***C10M 133/16*** | (2006.01) |
| ***C10M 133/44*** | (2006.01) |
| ***C10M 133/46*** | (2006.01) |
| ***C10M 145/26*** | (2006.01) |
| ***C10M 161/00*** | (2006.01) |
| *C10N 20/00* | (2006.01) |
| *C10N 40/00* | (2006.01) |
| *C10N 30/12* | (2006.01) |

(52) U.S. Cl.

CPC ..... *C10M 169/044* (2013.01); *C10M 129/70* (2013.01); *C10M 133/16* (2013.01); *C10M 133/44* (2013.01); *C10M 133/46* (2013.01); *C10M 145/26* (2013.01); *C10M 161/00* (2013.01); *C10M 2207/281* (2013.01); *C10M 2209/104* (2013.01); *C10M 2215/223* (2013.01); *C10M 2215/224* (2013.01); *C10M 2215/28* (2013.01); *C10M 2290/00* (2013.01); *C10N 2020/09* (2020.05); *C10N 2030/12* (2013.01); *C10N 2040/135* (2020.05)

(58) Field of Classification Search

CPC ..... C10M 169/044; C10M 129/70; C10M 133/16; C10M 133/44; C10M 133/46; C10M 145/26; C10M 161/10; C10M 2209/104; C10M 2215/223; C10M 2215/224; C10M 2215/28; C10M 2290/00; C10M 2215/08; C10M 2207/289; C10M 169/04; C10M 141/06; C10M 169/048; C10M 2207/283; C10N 2030/12

USPC ..... 508/280

See application file for complete search history.

(56) References Cited

U.S. PATENT DOCUMENTS

| | | | | |
|---|---|---|---|---|
| 3,219,666 | A | 11/1965 | Normal et al. | |
| 3,565,804 | A | 2/1971 | Honnen et al. | |
| 3,634,515 | A | 1/1972 | Piasek et al. | |
| 3,697,574 | A | 10/1972 | Piasek et al. | |
| 3,736,357 | A | 5/1973 | Piasek et al. | |
| 4,234,435 | A | 11/1980 | Meinhardt et al. | |
| 4,636,322 | A | 1/1987 | Nalesnik | |
| 4,734,209 | A | 3/1988 | Phillips et al. | |
| 5,266,223 | A | 11/1993 | Song et al. | |
| 5,599,779 | A | 2/1997 | Karol et al. | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,936,041 | A | 8/1999 | Diana et al. | |
| 6,043,199 | A * | 3/2000 | Godici | C10M 133/44 508/285 |
| 6,255,263 | B1 * | 7/2001 | Ryan | C10M 145/36 508/579 |
| 8,227,391 | B2 | 7/2012 | Ryan et al. | |
| 2009/0247436 | A1 * | 10/2009 | Wardlow | C10M 169/04 508/304 |
| 2010/0093574 | A1 * | 4/2010 | Nagakari | C10M 141/06 508/304 |
| 2012/0101017 | A1 | 4/2012 | Duggal | |
| 2014/0179570 | A1 * | 6/2014 | Loper | C10M 133/16 508/186 |

FOREIGN PATENT DOCUMENTS

| | | |
|---|---|---|
| EP | 0612839 A1 | 8/1994 |
| EP | 1078977 A1 | 2/2001 |
| GB | 2265149 A | 9/1993 |

OTHER PUBLICATIONS

Extended European Search Report for corresponding European Patent Application No. 20174279.8 dated Oct. 9, 2020, 9 pages.

* cited by examiner

*Primary Examiner* — Prem C Singh
*Assistant Examiner* — Francis C Campanell
(74) *Attorney, Agent, or Firm* — Honigman LLP

(57) ABSTRACT

Turbine lubricant additives and lubricants including such additives that provide rust prevention and water separation but also pass the demanding stage II wet filterability at the same time.

18 Claims, No Drawings

ADDITIVE AND LUBRICANT FOR INDUSTRIAL LUBRICATION

CROSS-REFERENCE TO RELATED APPLICATION

The present application claims priority to U.S. Provisional Application No. 62/847,085 filed on May 13, 2019, which is incorporated by reference herein in its entirety.

TECHNICAL FIELD

The present disclosure relates to additives and lubricants including such additives for industrial applications, and in particular, lubricant additives and lubricants for turbine applications maintaining rust and water separation performance together with high filterability in the presence of water.

BACKGROUND

Industrial lubricants tends to cover a broad range of applications spanning from turbines, gears, hydraulic, grease, and slideway applications. These high performance industrial lubricants are often required to pass a set demanding performance characteristics and manufacturers often tailor a fluid and the additives for such fluid to meet the desired application. As such, fluids and additives for one application may not pass the necessary performance minimums for another application.

Turbine lubricants, for instance, commonly require very stringent performance demands. Many turbine applications are exposed to the environment, steam, excessive heat, and other contaminates. Thus, only the highest-quality lubricants are able to withstand the wet conditions, high temperatures, and long periods of service associated with turbine operation. The nature and application of these fluids makes them very susceptible to contamination, particularly from other lubricants and additives. A relatively small degree of contamination can markedly affect the properties and expected service life of these lubricants. Moreover, to maintain effective operating conditions and to minimize damaging the equipment in which they are used, turbine oils should be kept clean and substantially free of contaminants. Thus, contamination is minimized by filtration To this end, many industrial lubricants, and in particular, turbine lubricants, generally meet minimum performance requirements in the context of rust prevention per ASTM D665B and/or demulsibility per ASTM D1401. To achieve this, fluids may include a rust preventive additive and demulsifier, among other additives, to meet such requirements. However, in the context for lubricants in turbine applications, commonly used rust preventative and demulsifier additives tend to negatively impact a more recently developed filterability characteristic that is now being required by more and more turbine operators.

The ability of a lubricating fluid to pass through fine filters, without plugging, is generally called filterability. ISO 13357-1 provides a demanding procedure for assessing the filterability of lubricating oils that have been heat-soaked in the presence of water. This so-called wet-filtration test typically involves two measurements or, as referred to in the test, two stages. This test is intended to estimate the behavior of the fluid when in service, such as when used in a turbine application. Stage I of wet-filterability is a comparison of the mean flow rate of a fluid through a test membrane relative to the initial flow rate. Stage II of wet filterability is a more severe evaluation and is based upon a ratio between the initial flow rate of lubricant through the test membrane and the rate at the end of the test. The stage II evaluation is more difficult to pass, and is believed to be sensitive to the presence of gels and fine particulate in the oil, which may be present in a lubricant or base oil slate when produced, or in other instances, gels and particulate could be formed as a lubricant ages, especially when exposed to humidity and elevated temperatures. As appreciated by those of skill, passing a wet-filterability stage II test is a challenge while still maintaining the other required characteristics of the fluid.

SUMMARY

In one approach or embodiment, an additive package for a turbine lubricant to provide rust prevention and high filterability in the presence of water is described herein. In one aspect, the additive package includes a rust-preventing mixture including at least an imidazoline derivative of an alkenyl succinic acid or anhydride combined with additives selected from a partial ester of a polyhydric alcohol, an acyl sarcosine compound, and mixtures thereof, a corrosion inhibiting additive selected from at least a substituted benzotriazole. In some approaches or embodiments, the additive package also includes a weight ratio of imidazoline provided by the rust-preventing mixture to triazole provided by the corrosion inhibitor of about 1:1 to about 2:1 with no more than 10 weight percent of the one or more imidazoline derivatives in the additive package.

The additive package of the preceding paragraph may be combined with one or more optional features in any combination. These optional features include: a copolymer additive having one or more polypropylene oxide derived moieties and of one or more polyethylene oxide derived moieties and having a number average molecular weight of about 3200 g/mol to about 4300 g/mol; and/or wherein the additive package includes about 3 to about 7 weight percent of the imidazoline derivative of an alkenyl succinic acid or anhydride, about 0.5 to about 3 weight percent of the partial ester of a polyhydric alcohol, about 0.5 to about 3 weight percent of the acyl sarcosine compound, and about 3 to about 8 weight percent of the substituted benzotriazole; and/or wherein the additive package includes about 0.02 to about 1 weight percent of the copolymer additive; and/or wherein the imidazoline derivative is the reaction product of an alkenyl succinic acid or anhydride and an amino-substituted imidazoline; and/or wherein the partial ester of a polyhydric alcohol is the reaction product of pentaerythritol and a C13 to a C20 unsaturated fatty acid; and/or wherein the acyl sarcosine compound is selected from sarcosine fatty acids having a C12 to C20 acyl group; and/or wherein the acyl sarcosine compound is selected from lauroyl sarcosine, cocyl sarcosine, oleoyl sarcosine, stearoyl sarcosine, tall oil acyl sarcosine, and mixtures thereof; and/or; with no more than about 7 weight percent of the imidazoline derivative in the additive package; and/or wherein the rust-preventing mixture includes about 1.5 to about 2.5 times more of the imidazoline derivative relative to the partial ester of a polyhydric alcohol and the acyl sarcosine compound combined.

In another aspect or embodiment, this disclosure also provides a turbine lubricant to provide rust prevention and high filterability in the presence of water. In some approaches, the turbine lubricant includes a base oil of lubricating viscosity selected from a Group I, Group II, or Group III oil, or blends thereof; a first lubricant additive including a compound of Formula I (Formula I)

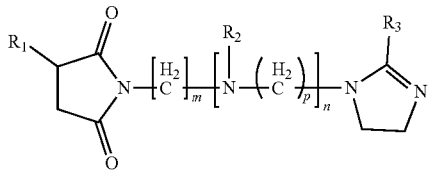

wherein R1 and R3 are, independently, a hydrocarbyl group having 10 to 19 carbons, and R2 is hydrogen, a hydrocarbyl group having 10 to 20 carbons, or a residue derived from a hydrocarbyl substituted dicarboxylic acid or anhydride thereof; a second lubricant additive including a compound of Formula II (Formula II)

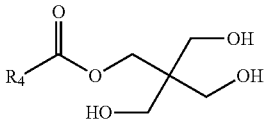

wherein R4 is a C13 to C20 saturated or unsaturated hydrocarbyl chain; a third lubricant additive including a compound of Formula III, (Formula III)

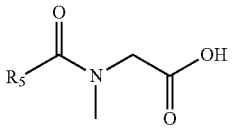

wherein R5 is a saturated or unsaturated C12 to C20 hydrocarbyl group; a fourth lubricant additive of Formula IV (Formula IV)

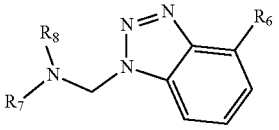

wherein R6 is a C1 to C5 hydrocarbyl group and R7 and R8 are, independently, a C1 to C10 linear or branched hydrocarbyl group. In other approaches or embodiments, the turbine lubricant has a weight ratio of imidazoline provided by the first lubricant additive to triazole provided by the fourth lubricant additive of about 1:1 to about 2:1 with no more than 0.1 weight percent of the first lubricant additive.

The turbine lubricant of the preceding paragraph may also be combined with one or more optional features in any combination. These optional features include: a copolymer having one or more polypropylene oxide derived moieties with a total molecular weight of less than about 3400 g/mol and about 5 to about 15 percent of one or more polyethylene oxide derived moieties; and/or wherein the turbine lubricant includes about 0.01 to about 0.05 weight percent of the first lubricant additive, about 0.005 to about 0.1 weight percent of the second lubricant additive (in other approaches, 0.01 to about 0.1 wt %), about 0.005 to about 0.1 weight percent of the third lubricant additive (in other approaches, about 0.01 to about 0.1 wt %), and about 0.01 to about 0.07 weight percent of the fourth lubricant additive; and/or wherein the turbine lubricant includes about 0.001 to about 0.01 weight percent of the copolymer; and/or; with no more than 0.05 weight percent of the first lubricant additive; and/or wherein the turbine lubricant includes about 1.5 to about 2.5 times more of the first lubricant additive relative to the second and third lubricant additives combined; and/or wherein the turbine lubricant exhibits more than about 70 percent stage II filterability according to ISO 13357-1; and/or wherein the base oil includes a blend of Group I and Group II base oils having and has a KV40 of about 30 to about 100 cSt (in other approaches, about 30 to about 70); and/or wherein the turbine lubricant includes about 0.12 to about 0.35 weight percent of the combined first, second, third, and fourth lubricant additives; and/or wherein the turbine lubricant exhibits more than about 70 percent stage II filterability according to ISO 13357-1, a passing rust performance according to ASTM D665B, and less than about 10 minutes to 37 ml of water separation according to ASTM D1401.

DETAILED DESCRIPTION

Industrial lubrication involves fluids for applications that may include hydraulic oils, industrial gear oils, slideway machines oils, circulation oils for steam turbine, gas turbine, heavy-duty turbines and aircraft turbines, way lubricants, gear oils, compressor oils, mist oil, wind turbines, and machine tool lubricants to suggest but a few applications. These fluids commonly include a base oil or blend of base oils combined with a selection of additives to meet performance characteristics for such application. As explained in the background, fluids designed for one application do not necessarily perform in other industrial applications.

In the context of lubricating oils for turbine applications, recent performance demands now require passing the so-called stage II wet-filterability while still maintaining other performance characteristics at the same time. It has been discovered that certain additives used in prior industrial lubricants tend to negatively affect stage II wet-filterability. These additives includes carboxy-imidazoline rust inhibitors, tolytriazole corrosion inhibitors, and certain demulsifiers. In the context of turbine applications needing to pass minimum rust prevention and water separation requirements, these and similar additives cannot simply be removed from the fluids to improve wet filterability. The present application, therefore, discovered a unique combination of additives that not only provide the desired rust prevention and water separation but also pass the demanding stage II wet filterability at the same time.

In one approach, the present disclosure provides an additive package or concentrate for turbine lubricants, and to the turbine lubricants, that achieve passing rust prevention per ASTM D665B, passing or exceeding water separation per ASTM D1401, and passing or exceeding wet-filterability stage II evaluation per ISO 13357-1. In one approach, the additives and lubricants herein achieve water separation per ASTM D1401 of less than 15 minutes to 37 ml of water, and in other approaches, less than 10 minutes. In other approaches, the additives and lubricants herein achieve greater than 50 percent stage II filtration, and in other approaches, greater than 70 percent. The disclosure also provides additives and lubricants as described throughout this disclosure for the use of passing these three evaluations at the same time as well as methods of lubricating metal surfaces using lubricants with the additives described throughout this disclosure. In one embodiment, the metal surfaces being lubricated can be a machine part. The machine part can include, but not be limited to, an axle, a differential, an engine, a manual transmission, an automatic transmission, a continuously variable transmission, a clutch, a hydraulic apparatus, an industrial gear, a slideway apparatus, and/or a turbine part.

In one aspect, the present disclosure relates to an additive package for a turbine lubricant to provide rust prevention, water separation, and high filterability in the presence of water at the same time. In some approaches or embodiments, the additive package includes effective amounts of a multi-component rust-preventing mixture combined with a corrosion inhibiting additive to meet the performance characteristics noted in the prior paragraph. In one approach, the multi-component rust-preventing mixture includes effective amounts of a carboxy-imidazoline mixture or an imidazoline derivative of an alkenyl succinic acid or anhydride combined with additives selected from a partial ester of a polyhydric alcohol, an acyl sarcosine compound, and mixtures thereof. In other approaches, the corrosion inhibiting additive may be effective amounts of at least a substituted benzotriazole.

In other approaches, it has also been discovered that an unexpected weight ratio of the imidazoline provided by the rust-preventing mixture to the triazole provided by the corrosion inhibitor is helpful to meet the trifecta of performance characteristics at the same time (that is rust prevention, water separation, and wet filtration). In some approaches, this ratio is about 1:1 to about 2:1 of the imidazoline to the triazole with no more than 10 weight percent of the one or more imidazoline derivatives in the additive package. In other approaches in the context of a lubricant including the additives herein, the turbine lubricant with the additives herein has a weight ratio of imidazoline provided by the carboxy-imidazoline (or first additive) to triazole provided by the corrosion inhibitor (or fourth lubricant additive) of about 1:1 to about 2:1 with no more than 0.1 weight percent of the first lubricant additive. Thus, the additives herein minimize the amount of the imidazoline that tended to negatively affect the wet-filterability. As the purpose of these additives was for rust prevention and water separation, it was not expected such additives, or in some approaches, the unique combination thereof would have any effect on wet filterability in the context of turbine lubricants.

In yet further approaches, the additive and fluids herein may also include a copolymer additive, such as a block copolymer additive, effective to provide water separation without negatively affecting the wet filtration. For instance and in one approach, the copolymer may be polyoxyalkylene polyols. In other approaches, the polyoxyalkylene polyols may have a number average molecular weight of about 3200 to about 4300 g/mol and may have one or more polypropylene oxide derived moieties and, in some approaches, one or more polyethylene oxide derived moieties and, in yet other approaches, about 5 to about 15 percent of one or more polyethylene oxide derived moieties. This additive, in combination with the above described additives, tended to further aid in meeting the trifecta of performance characteristics at the same time. It was also unexpected that a demulsifcation agent would have any effect on wet filtration.

Rust Preventative Mixture:

The additives and lubricants herein include a multi-component mixture of selected rust preventative additives. In one approach, the additive and lubricants herein include at least three or more additives to maintain rust performance. In some approaches, the additive has no more than 7 percent of any one rust preventative additive and preferably less of each additive. However, the select combination and ratios of additives aids in achieving rust prevention and wet filterability. As noted above, the rust preventative mixture includes blends of at least one or more of a carboxy-imidazoline, one or more of partial esters of polyhydric alcohols, one or more acyl sarcosine compounds, and mixtures thereof as long as the additive and fluid includes at least three of the compounds at the same time. Each will be described further below.

The Carboxy-Imidazoline Compound:

In one approach, the carboxy-imidazoline compound in the additives and lubricants herein is an imidazoline derivative of an alkenyl succinic acid or anhydride providing the imidazoline moiety to the fluids and additives herein. The imidazoline derivative may be the reaction product of linear or branched alkyl or alkenyl succinic acid or anhydride and an amino-substituted imidazoline. In some approaches, this reaction product is linear or branched alkyl or alkenyl substituted succinimide or acid or amine substituted imidazoline succinimide or acid having the structure of Formula I (Formula I)

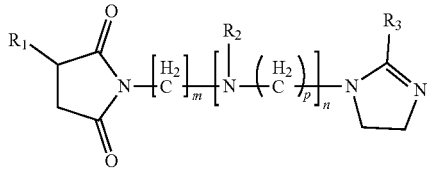

wherein R1 and R3 are, independently, a saturated or unsaturated hydrocarbyl group having 10 to 19 carbons (in other approaches, 10 to 14 carbons), and R2 is hydrogen, a saturated or unsaturated hydrocarbyl group having 10 to 20 carbons (in other approaches, 16 to 20 carbons), or a residue derived from a hydrocarbyl substituted dicarboxylic acid or anhydride thereof. In Formula I, m, n, and p are integers and may each independently range from 1 to 10. In some approach, m is 1 to 4, n is 1 to 2, and p is 1 to 4, but m, n, and p may vary as needed depending on the application and context of the fluid.

An additive package or concentrate may include no more than about 10 weight percent of the carboxy-imidazoline, in other approaches, no more than 8 weight percent, no more than 7 weight percent, or not more than 6 weight percent. In other approaches, the additive package or concentrate may include about 1 to about 10 weight percent of the carboxy-imidazoline, in other approaches, an amount ranging from at least about 1 weight percent, at least about 2 weight percent, at least about 3 weight percent, at least about 4 weight percent, at least about 5 weight percent, or at least about 6 weight percent to less than about 10 weight percent, less than about 9 weight percent, less than about 8 weight percent, less than about 7 weight percent, less than about 5 weight percent, or less than about 4 weight percent.

In a finished lubricant, the fluid may include no more than about 0.1 weight percent of the carboxy-imidazoline additive, in other approaches, no more than about 0.08 weight percent, no more than about 0.07 weight percent, no more than about 0.06 weight percent, or no more than about 0.05 weight percent. In yet other approaches, the finished lubricant may include about 0.01 to about 0.1 weight percent of the carboxy-imidazoline, in other approaches, an amount ranging from at least about 0.01 weight percent, at least about 0.02 weight percent, at least about 0.03 weight percent, at least about 0.04 weight percent, at least about 0.05 weight percent, or at least about 0.06 weight percent to less than about 0.1 weight percent, less than about 0.09 weight percent, less than about 0.08 weight percent, less than about 0.07 weight percent, less than about 0.05 weight percent, or less than about 0.04 weight percent Partial Ester of Polyhydric Alcohols In one approach, the partial ester of a polyhydric alcohol for the additives and lubricants herein may be a polyglycerol fatty acid ester or a mixture of different polyglycerol fatty acid esters wherein the polyglycerol or polyhydric alcohol base includes up to and including 10 glycerol or hydroxyl units that are partially esterified by at least one and up to 9 acid radicals of saturated or unsaturated carboxylic acids having from 8 to 20 carbon atoms. In other approaches, the partial ester of a polyhydric alcohol is an ester with at least one of the hydroxyl groups of the polyhydric alcohol remaining as hydroxyl without being esterified. One yet another approach or embodiment, polyhydric alcohol selected from the group consisting of glycerin, trimethylolethane, trimethylolpropane, pentaerythritol and sorbitan may be suitable.

The carboxylic acid in the partial ester may be any suitable acid for use in turbine applications. In one approach, the carboxylic has between 10 and 30 carbons, in other approaches, 12 and 24 carbons, and in yet other approaches, 16 to 22 carbons. The carboxylic acid may be a saturated carboxylic acid or unsaturated carboxylic acid, and it may be a straight-chain carboxylic acid or a branched-chain carboxylic acid. Suitable carboxylic acids may be capric acid, lauric acid, myristic acid, palmitic acid, stearic acid, oleic acid, behenic acid, palmitoleic acid, arachidic acid, linoleic acid, linolenic acid, and the like fatty carboxylic acids.

In yet other approaches, the partial ester is a second lubricant additive of the fluids herein and may include a compound of Formula II (Formula II)

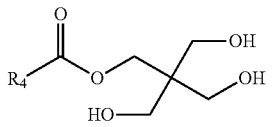

wherein R4 is a C13 to C20 saturated or unsaturated, linear or branched hydrocarbyl chain. In one approach, R4 is a C16 to C20 unsaturated linear hydrocarbyl chain.

In any approach herein, the additive may include about 0.5 to about 4 weight percent of the partial ester of polyhydric alcohol or, in other approaches, about 0.8 to about 2 weight percent. The finished lubricants herein may include about 0.005 to about 0.1 weight percent of the partial ester of polyhydric alcohols, in other approaches about 0.01 to about 0.1 weight percent. The additive and lubricant may also include other ranges within the noted end points as needed for a particular additive or lubricant as the case may be.

Acyl Sarcosine

In one approach, the acyl sarcosine compound of the fluids and lubricants herein is a acyl N-methyl glycine or derivative thereof of Formula III (Formula III)

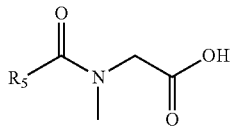

wherein R5 is a saturated or unsaturated, linear or branched, C12 to C20 hydrocarbyl group, and in other approaches, is a C14 to C18 saturated, linear hydrocarbyl group. The sarcosine compounds are obtained by reacting n-methyl glycines with suitable fatty acids. In some approaches, suitable acyl sarcosine for use in the turbine lubricants herein to aid in achieving high wet filterability include lauroyl sarcosine, cocyl sarcosine, oleoyl sarcosine, stearoyl sarcosine, tall oil acyl sarcosine, 2-(N-methyloctadeca-9-enamido)acetic acid, 2-(N-methyldodecanamido)acetic acid, 2-(N-methyltetradecanamido)acetic acid, 2-(N-methylhexadecanamido)acetic acid, 2-(N-methyloctadecanamido)acetic acid, 2-(N-methylicosanamido)acetic acid, and 2-(N-methyldocosanamido)acetic acid; and the like.

In some approaches, the acyl sarcosine of the present disclosure may be esters. Some esters suitable for use in the present disclosure include, but are not limited to ethyl esters of oleoyl sarcosine, ethyl esters of lauroyl sarcosine, butyl esters of oleoyl sarcosine, ethyl esters of cocoyl sarcosine, pentyl esters of lauroyl sarcosine, and the like esters. For instance, the ester may be a reaction product of an acyl N-methyl glycine and at least one alcohol, which may be a $C_1$-$C_8$ alcohol such as methanol, ethanol, n-propanol, isopropanol, n-butanol, isobutanol, tertiary butanol, pentanols such as n-pentanol, isopentanol, hexanols, heptanols and octanols as well as unsaturated $C_1$-$C_8$ alcohols and heteroatom containing $C_1$-$C_8$ alcohols such as ethane-1,2-diol, 2-methoxyethanol, ester alcohols or amino alcohols, such as triethanol amine.

In any approach herein, the additive may include about 0.5 to about 4 weight percent of the acyl sarcosine, or in other approaches, about 0.8 to about 2 weight percent. The finished lubricant herein may include about 0.005 to about 0.1 weight percent of the acyl sarcosine, in other approaches about 0.01 to about 0.1 weight percent. Both the additive and the lubricant may also include other ranges within such end points as needed for a particular additive or lubricant.

Corrosion Inhibitor

In one approach, the corrosion inhibitor or fourth lubricant additive of the additives and fluids herein is a substituted benzotriazole providing triazole moieties to the additives and fluids. In one approach, the inhibitor may be N,N-disubstituted aminomethylbenzotriazole of the Formula (IV) below or an N,N-disubstituted aminomethyl-1,2,4-triazole, or mixtures thereof. In some instances, unsubstituted tolytriazole or benzotriazole may be added. The N,N-disubstituted aminomethylbenzotriazole can be prepared by known methods, as described, for example, in U.S. Pat. No. 4,701,273, such as reacting a benzotriazole with formaldehyde and an amine. The N,N-disubstituted aminomethyl-1,2,4 triazole compounds can be similarly prepared, namely by reacting a 1,2,4-triazole with formaldehyde and an amine as described in U.S. Pat. No. 4,734,209.

In one approach, the corrosion inhibitor or a fourth lubricant additive has the structure of Formula IV (Formula IV)

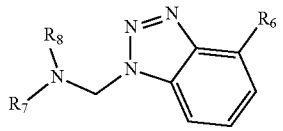

wherein R6 is a C1 to C5 hydrocarbyl group (in other approaches, a C1-C2 group) and R7 and R8 are, independently, a C1 to C10 linear or branched hydrocarbyl group (in other approaches, a C4 to C8 group). In one approach, the corrosion inhibitor is 1-[bis(2-ethylhexyl)aminomethyl-4-methylbenzotriazole or 1-[bis(2ethylhexyl)aminomethyl]-1,2,4-triazole, available from CIBA under the product names IRGAMET® 39 and IRGAMET® 30, respectively.

In any approach herein, the additive may include about 4 to about 10 weight percent of the corrosion inhibitor discussed above, or in other approaches, about 4 to about 7 weight percent. The finished lubricant herein may include about 0.01 to about 0.07 weight percent of the corrosion inhibitor, in other approaches about 0.01 to about 0.05 weight percent. The additive or the lubricant may also include other ranges within such end points as needed for a particular application of the additive or lubricant.

Polyoxyalkylene Copolymer

In yet another approach, the additives and lubricants herein may also optionally further include certain copolymer demulsifiers. In one approach, the demulsifier component may be polyoxyalkylene polyols and, in other approaches, liquid polyoxyalkylene polyols. In some approaches, the optional polyoxyalkylene polyols are block copolymers and often triblock copolymers.

For example, a hydroxy-substituted compound, R(OH)n (where n may be 1 to 10, and R may the residue of a mono or polyhydric alcohol) may be reacted with an alkylene oxide (usually propylene oxide or ethylene oxide) to form a hydrophobic base. This base is then reacted with another alkylene oxide (usually the other of propylene oxide or ethylene oxide) to provide a hydrophilic portion resulting in a copolymer having both hydrophobic and hydrophilic portions. The relative sizes of these portions can be adjusted as need for a particular application. As discussed more below, select demulsifiers were discovered to work together with the rust preventing additives to provide superior wet filterability. Exemplary hydroxyl-substituted compounds (R(OH)n) for the demulsifier copolymer include, but are not limited to, alkylene polyols such as the alkylene glycols, alkylene triols, alkylene tetrols, and the like including ethylene glycol, propylene glycol, glycerol, pentaerylthritol, sorbitol, mannitol, and the like.

In the present application, liquid triblock polyol copolymers were discovered to function together with the rust preventive mixture in the context of turbine lubricants and achieving high wet filterability. It was not anticipated that such component would have any effect on filterability given that its purpose was for demulsification. In some approaches, certain triblock polyols correspond to the Formula HO-(EO)x(PO)y(EO)z-H wherein x, y, and z are integers greater than 1 such that, in some approaches, the EO groups include about 5 to about 15 percent of the total molecular weight of the additive and the total number average molecular weight of the additive is about 3200 g/mol to about 4300 g/mol, and, in other approaches, about 3200 g/mol to about 4200 g/mol. In yet another approach, the copolymer demulsifier additive has one or more polypropylene oxide derived moieties one or more polyethylene oxide derived moieties. In one approach, the copolymer having the polypropylene oxide derived moieties and the polyethylene derived moieties has a number average weight of about 3200 g/mol to about 4200 g/mol, in other approaches, about 3200 g/mol to about 4,000 g/mol.

In any approach herein, the additive may include about 0 to about 1.5 weight percent of the copolymer, or in other approaches, about 0.05 to about 1 weight percent. The finished lubricant herein may include about 0.001 to about 0.01 weight percent of the polyoxyalkylene copolymer, in other approaches about 0.002 to about 0.01 weight percent. The additives and lubricant may also include other ranges within such end points as needed for a particular application.

Combination of Additives

In the context of turbine applications, the above blend of additives uniquely provides rust prevention, demulsification, and high wet-filtration. For instance and in one approach, a discovered weight ratio of imidazoline provided by the rust-preventing mixture to triazole provided by the corrosion inhibitor of about 1:1 to about 2:1 with no more than 10 weight percent of the one or more imidazoline derivatives in the additive package unexpectedly provided the trifecta of performance (that is, rust prevention, demulsification, and wet filtration) at the same time. In other approaches, the rust-preventing mixture may also include about 1.5 to about 2.5 times more of the imidazoline derivative relative to the partial ester of a polyhydric alcohol and the acyl sarcosine compound combined while again maintaining less than about 10 weight percent of the imidazoline derivative in the package.

This unique blend of additives as described in any of the above paragraphs either individually or in combination and in the context of a turbine lubricant achieves greater than 50% stage II wet-filtration per ISO 13357-1 and, in other approaches, greater than 70%, greater than 80% stage II wet-filtration. In yet other approaches, the additives and fluids herein achieve at least about 50% stage II wet-filtration, at least about 60%, at least about 70 percent or at least about 80% and less than about 90%, less than about 80%, less than about 70%, or less than about 60% stage II wet filtration per ISO 13357-1. At the same time, the fluids and additives achieve passing rust prevention per ASTM D665B and less than about 15 minutes to 37 ml of water separation according to ASTM D1401.

Base Oil

In one approach, suitable base oils are mineral oils and include all common mineral oil basestocks. The mineral oil may be naphthenic or paraffinic. The mineral oil may be refined by conventional methodology using acid, alkali, and clay or other agents such as aluminium chloride, or may be an extracted oil produced, e.g. by solvent extraction with solvents such as phenol, sulfur dioxide, furfural or dichlorodiethyl ether. The mineral oil may be hydrotreated or hydrofined, dewaxed by chilling or catalytic dewaxing processes, or hydrocracked, such as the Yubase® family of hydrocracked base oils from SK Innovation Co., Ltd. (Seoul, Korea). The mineral oil may be produced from natural crude sources or be composed of isomerized wax materials or residues of other refining processes.

In other approaches, the additive package or concentrate as described in any of the paragraphs above may also be blended in a base oil or a blend of base oil suitable for use in a turbine application. The base oil or base oil of lubricating viscosity used in the compositions herein may be selected from any suitable base oil for Turbine applications. Examples include the base oils in Groups I-III as specified in the American Petroleum Institute (API) Base Oil Interchangeability Guidelines. These three base oil groups are as follows:

TABLE 1

| Base oil Types | | | | |
|---|---|---|---|---|
| Base oil Category | Sulfur (%) | | Saturates (%) | Viscosity Index |
| Group I | >0.03 | and/or | <90 | 80 to 120 |
| Group II | <0.03 | and | >90 | 80 to 120 |
| Group III | <0.03 | and | >90 | >120 |

Groups I, II, and III are mineral oil process stocks and may be preferred for the turbine oils of the present application. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof. In some approaches, the base oil may be a blend of Group I and Group II oils and the blend may be about 0% to about 100% of the Group I oil, about 0% to about 100% of the Group II oil, about 0% to about 100% of the Group III oil, or various blends of Group I and II, Group I and III, or Group II and III oil blends.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

The major amount of base oil included in a lubricating composition may be selected from the group consisting of Group I, Group II, a Group III, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group I, a Group II, and a combination of two or more of the foregoing, and wherein the major amount of base oil is other than base oils that arise from provision of additive components or viscosity index improvers in the composition.

The amount of the oil of lubricating viscosity in the compositions herein may be the balance remaining after subtracting from 100 wt % the sum of the amount of the performance additives. For example, the oil of lubricating viscosity that may be present in a finished fluid may be a "major amount," such as greater than about 50 wt %, greater than about 60 wt %, greater than about 70 wt %, greater than about 80 wt %, greater than about 85 wt %, greater than about 90 wt %, or greater than 95 wt %.

In some approaches, a preferred base oil or base oil of lubricating viscosity has less than about 25 ppm sulfur, a viscosity index greater than about 100, or greater than about 120 (and in some cases, about 100 to about 120), and a kinematic viscosity at about 100° C. of about 2 to about 8 cSt. In other approaches, the base oil of lubricating viscosity has less than about 25 ppm sulfur, a viscosity index greater than 120, and a kinematic viscosity at 100° C. of about 4 cSt. The base oil may have CP (paraffinic carbon content) of greater than 40%, greater than 45%, greater than 50%, greater than 55%, or greater than 90%. The base oil may have a CA (aromatic carbon content) of less than 5%, less than 3%, or less than 1%. The base oil may have a CN (naphthenic carbon content) of less than 60%, less than 55%, less than 50%, or less than 50% and greater than 30%. The base oil may have a ratio of 1 ring naphthenes to 2-6 ring naphthenes of less than 2 or less than 1.5 or less than 1.

A suitable additive and lubricant composition herein may include additive components in the ranges listed in the following Tables 2 and 3.

TABLE 2

| Additive Composition | | |
|---|---|---|
| Component | Wt % (Suitable Embodiments) | Wt % (Preferred Embodiments) |
| Carboxy-imidazoline | 3 to 10 | 4 to 8 |
| Partial ester of polyhydric alcohol | 0.5 to 4 | 0.8 to 2 |
| Acyl sarcosine | 0.5 to 4 | 0.8 to 2 |
| Benzotriazole | 4 to 10 | 4 to 7 |
| Polyoxyalkylene polyols | 0 to 1.5 | 0.05 to 1.0 |
| Other additives* | 35 to 70 | 45 to 65 |
| Solvent | Balance | Balance |

*the other additives may include antioxidants, anti-wear, extreme pressure additives, solvents, and the like additives.

TABLE 3

| Lubricant Compositions | | |
|---|---|---|
| Component | Wt % (Suitable Embodiments) | Wt % (Preferred Embodiments) |
| Additive of Table 2 | 0.3 to 1.2 | 0.4 to 0.75 |
| Antioxidant(s) | 0.1-5.0 | 0.01-4.0 |
| Ashless TBN booster(s) | 0.0-1.0 | 0.01-0.5 |
| Corrosion inhibitor(s) | 0.0-5.0 | 0.1-3.0 |
| Ash-free phosphorus compound(s) | 0.0-15.0 | 0.1-5.0 |
| Antifoaming agent(s) | 0.0-1.0 | 0.001-0.5 |
| Antiwear agent(s) | 0.0-1.0 | 0.0-0.8 |
| Pour point depressant(s) | 0.0-1.0 | 0.01-0.5 |
| Viscosity index improver(s) | 0.0-20.0 | 0.1-10.0 |
| Dispersants | 0.0-10.0 | 1.0-6.0 |
| Dispersant viscosity index improver(s) | 0.0-10.0 | 0.0-5.0 |

TABLE 3-continued

| Lubricant Compositions | | |
|---|---|---|
| Component | Wt % (Suitable Embodiments) | Wt % (Preferred Embodiments) |
| Friction modifier(s) | 0.0-10.0 | 0.01-4.0 |
| Base oil(s) | Balance | Balance |
| Total | 100 | 100 |

The percentages of each component above represent the weight percent of each component, based upon the weight of the total final additive or lubricating oil composition. The balance of the lubricating oil composition consists of one or more base oils or solvents. Additives used in formulating the compositions described herein may be blended into the base oil or solvent individually or in various sub-combinations. However, it may be suitable to blend all of the components concurrently using an additive concentrate (i.e., additives plus a diluent, such as a hydrocarbon solvent).

In other approaches, the turbine additive and lubricant including such additive may also include one or more optional components so long as such components and amounts thereof do not impact the performance characteristics as described in the above paragraphs. These optional components are described in the following paragraphs.

Phosphorus-Containing Compounds

The lubricant composition herein may comprise one or more phosphorus-containing compounds that may impart anti-wear benefits to the fluid. The one or more phosphorus-containing compounds may be present in the lubricating oil composition in an amount ranging from about 0 wt % to about 15 wt %, or about 0.01 wt % to about 10 wt %, or about 0.05 wt % to about 5 wt %, or about 0.1 wt % to about 3 wt % of the lubricating oil composition. The phosphorus-containing compound may provide up to 5000 ppm phosphorus, or from about 50 to about 5000 ppm phosphorus, or from about 300 to about 1500 ppm phosphorus, or up to 600 ppm phosphorus, or up to 900 ppm phosphorus to the lubricant composition.

The one or more phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 5 to about 20 weight percent phosphorus, or about 5 to about 15 weight percent phosphorus, or about 8 to about 16 weight percent phosphorus, or about 6 to about 9 weight percent phosphorus.

Another type of phosphorus-containing compound that when combined with the olefin copolymer dispersant herein imparts improved frictional characteristics to a lubricating composition is an ashless (metal free) phosphorus-containing compound.

In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof.

The ashless phosphorus-containing compound may be have the formula:

(Formula XIV)

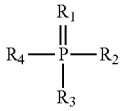

wherein R1 is S or O; R2 is —OR", —OH, or —R"; R3 is —OR", —OH, or SR'"C(O)OH; R4 is —OR"; R'" is C1 to C3 branched or linear alkyl chain; and R" is a C1 to C18 hydrocarbyl chain. When the phosphorous-containing compound has the structure shown in Formula XIV, the compound may have about 8 to about 16 weight percent phosphorus.

In some embodiments the lubricant composition comprises a phosphorus-containing compound of Formula XIV wherein R1 is S; R2 is —OR"; R3 is SR'"COOH; R4 is —OR"; R'" is C3 branched alkyl chain; R" is C4; and wherein the phosphorus-containing compound is present in an amount to deliver between 80-900 ppm phosphorus to the lubricant composition.

In another embodiment, the lubricant composition comprises a phosphorus-containing compound of Formula XIV wherein R1 is O; R2 is —OH; R3 is —OR" or —OH; R4 is —OR"; R" is C5; and wherein phosphorus-containing compound is present in an amount to deliver between 80-1500 ppm phosphorus to the lubricant composition.

In yet another embodiment, the lubricant composition comprises a phosphorus-containing compound of Formula XIV wherein R1 is O; R2 is OR"; R3 is H; R4 is —OR"; R" is C4; and wherein the one or more phosphorus-containing compound(s) is present in an amount to deliver between 80-1550 ppm phosphorus to the lubricant composition.

In other embodiments, the lubricant composition comprises a phosphorus-containing compound of Formula XIV wherein R1 is O; R2 is —R"; R3 is —OCH3 or —OH; R4 is —OCH3; R" is C18; and wherein the one or more phosphorus-containing compound(s) is present in an amount to deliver between 80-850 ppm phosphorus to the lubricant composition.

In some embodiments, the phosphorus-containing compound has the structure shown in Formula XIV and delivers about 80 to about 4500 ppm phosphorus to the lubricant composition. In other embodiments, the phosphorus-containing compound is present in an amount to deliver between about 150 and about 1500 ppm phosphorus, or between about 300 and about 900 ppm phosphorus, or between about 800 to 1600 ppm phosphorus, or about 900 to about 1800 ppm phosphorus, to the lubricant composition.

Anti-Wear Agents

The lubricant composition may also include anti-wear agents that are non-phosphorus-containing compounds. Examples of such antiwear agents include borate esters, borate epoxides, thiocarbamate compounds (including thiocarbamate esters, alkylene-coupled thiocarbamates, and bis (S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

Useful antioxidants may include diarylamines and phenols. In an embodiment, the lubricating oil composition may contain a mixture of a diarylamine and a phenol, such that each antioxidant may be present in an amount sufficient to provide up to about 5 wt %, based on the weight of the lubricant composition. In an embodiment, the antioxidant may be a mixture of about 0.3 to about 1.5 wt % diarylamine and about 0.4 to about 2.5 wt % phenol, based on the lubricant composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the lubricating oil composition.

Additional Dispersants

Additional dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,634,515, 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In some embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

The additional dispersant, if present, can be used in an amount sufficient to provide up to about 10 wt %, based upon the final weight of the lubricating oil composition. Another amount of the dispersant that can be used may be about 0.1 wt % to about 10 wt %, or about 0.1 wt % to about 10 wt %, or about 3 wt % to about 8 wt %, or about 1 wt % to about 6 wt %, based upon the final weight of the lubricating oil composition.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, about 3 wt % to about 20 wt %, about 3 wt % to about 15 wt %, about 5 wt % to about 15 wt %, or about 5 wt % to about 10 wt %, of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about 150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in optional amount sufficient to provide about 0 wt % to about 5 wt %, about 0.01 wt % to about 3 wt %, about 0.1 wt % to about 2 wt %, based upon the final weight of the lubricating oil composition.

The lubricant composition may also include corrosion inhibitors (it should be noted that some of the other mentioned components may also have copper corrosion inhibition properties). Suitable inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole, tolyltriazole, octyltriazole, decyltriazole; dodecyltriazole, 2-mercaptobenzothiazole, 2,5-dimercapto-1,3,4-thiadiazole, 2-mercapto-5-hydrocarbylthio-1,3,4-thiadiazoles, and 2-mercapto-5-hydrocarbyldithio-1,3,4-thiadiazoles. In one embodiment, the lubricant composition includes a 1,3,4-thiadiazole, such as 2-hydrocarbyldithio-5-mercapto-1,3,4-dithiadiazole.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

Turbine lubricants of Table 4 below were prepared with blends of the following components in Yubase 4 or Yubase 6 base oils:

Additive 1: carboxy-imidazoline obtained from the reaction of a linear or branched dodecenyl substituted succinic anhydride with a substituted amino-imidazoline. Commercially available as HiTEC® 536 (Afton Chemical).

Additive 2: pentaerythritolmonooleate commercially available as Radiasurf® 7156.

Additive 3: n-oleyl sarcosine commercially available as Crodasinic® O.

Additive 4: N,N-bis(2-ethylhexyl)-4-methyl-1H-benzotriazole-1-methylamine commercially available as Irgamet® 39.

Additive 5: tolytriazole TT100.

Additive 6: a polyethyleneoxide, polypropylene oxide, polyethylene oxide triblock copolymer having a molecular weight of 4400 g/mol and commercially available as Pluronic L121.

Additive 7: a polyethyleneoxide, polypropylene oxide, polyethylene oxide triblock copolymer having a molecular weight of 3800 g/mol and commercially available as Pluronic® L101.

Additive 8: liquid carboxylic acid corrosion inhibitor commercially available as Irgacor® 843.

Additive 9: difunctional block copolymer surfactant with terminal secondary hydroxyl groups commercially available as Pluronic® 25R2 having molecular weight of 3100 g/mol.

Other Additives: blend of antioxidants, anti-wear additives, extreme pressure additives.

The lubricants of Table 4 below were then evaluated for rust prevention (ASTM D665B), water separation (ASTM D1401), and stage II wet-filterability (ISO 13357-1). Results are provided in Table 5 below.

TABLE 4

Turbine lubricants including additive package and base oils.

| | Fluid | | | | |
|---|---|---|---|---|---|
| Additive Package (wt %) | A | B | C | D | E |
| Aromatic solvent (200 ND) | 0.13 | 0.18 | 0.21 | 0.21 | 0.15 |
| Additive 4 | — | — | — | — | 0.04 |
| Additive 5 | 0.009 | 0.009 | 0.009 | 0.009 | — |
| Additive 1 | 0.11 | 0.04 | | — | 0.04 |
| Additive 8 | — | — | 0.01 | — | — |
| Additive 3 | — | 0.01 | 0.01 | 0.015 | 0.01 |
| Additive 2 | — | 0.01 | 0.01 | 0.015 | 0.01 |
| Additive 6 | 0.003 | 0.003 | 0.003 | 0.003 | 0.003 |
| Additive 7 | 0.001 | 0.001 | 0.001 | 0.001 | 0.001 |
| Other additives | 0.35 | 0.35 | 0.35 | 0.35 | 0.35 |
| Total Additive package (wt %) | 0.6 | 0.6 | 0.6 | 0.6 | 0.6 |
| Group III base oil | Balance | Balance | Balance | Balance | Balance |
| Fluid KV 40 | 32 | 32 | 32 | 32 | 32 |

TABLE 5

Performance Evaluation

| | ASTM/ | Fluid | | | | |
|---|---|---|---|---|---|---|
| | ISO TM# | A | B | C | D | E |
| ISO Wet Stage I (%) | 13357-1 | 76.3 | 82.1 | 90.3 | 84.6 | 90 |
| ISO Wet Stage II (%) | 13357-1 | 47.9 | 65.1 | 82.2 | 72.2 | 81 |
| Time to 37 ml water | D1401 | 3'44 | 3'46 | 14'32 | 9'47 | 4'06 |
| Time to 3 ml emulsion | D1401 | 3'54 | 3'46 | 14'32 | 9'47 | 4'07 |
| Rust | D665B | pass | pass | pass | pass | pass |

*the format "x'yy" in Table 5 and elsewhere in this disclosure means x minutes and yy seconds.

As shown in Table 5 above, fluid E had the highest ISO wet stage II performance combined with the lowest water separation. Fluid C has poor water separation.

Example 2

The additives of Example 1 were further evaluated for varying amount of the benzotriazle and the demulsifier additives as shown in Tables 6A/B and 7

TABLE 6A

Turbine lubricants including additive package and base oils.

| | Fluid | | | | |
|---|---|---|---|---|---|
| Additive Package (wt %) | F | G | H | I | J |
| Aromatic solvent (200 ND) | 0.15 | 0.15 | 0.15 | 0.15 | 0.15 |
| Additive 4 | 0.04 | 0.03 | 0.02 | 0.04 | 0.04 |
| Additive 5 | — | — | — | — | — |
| Additive 1 | 0.04 | 0.04 | 0.04 | 0.04 | 0.04 |
| Additive 8 | — | — | — | — | — |
| Additive 3 | 0.01 | 0.01 | 0.01 | 0.01 | 0.01 |
| Additive 2 | 0.01 | 0.01 | 0.01 | 0.01 | 0.01 |
| Additive 6 | 0.003 | 0.003 | 0.003 | — | — |
| Additive 7 | 0.001 | 0.001 | 0.001 | | 0.002 |
| Additive 9 | — | — | — | — | 0.002 |
| Other additives | 0.35 | 0.35 | 0.35 | 0.35 | 0.35 |
| Total Additive package (wt %) | 0.6 | 0.59 | 0.58 | 0.59 | 0.6 |
| Group I Base oil | 39 | 39 | 39 | 39 | 39 |
| Group II Base oil | Balance | Balance | Balance | Balance | Balance |
| Fluid KV40 | 46 | 46 | 46 | 46 | 46 |

TABLE 6B

Turbine lubricants including additive package and base oils.

| | Fluid | | |
|---|---|---|---|
| Additive Package (wt %) | K | L | M |
| Aromatic solvent (200 ND) | 0.15 | 0.15 | 0.15 |
| Additive 4 | 0.04 | 0.04 | 0.04 |
| Additive 5 | — | — | — |
| Additive 1 | 0.04 | 0.04 | 0.04 |
| Additive 8 | — | — | — |
| Additive 3 | 0.01 | 0.01 | 0.01 |
| Additive 2 | 0.01 | 0.01 | 0.01 |
| Additive 6 | — | — | — |
| Additive 7 | 0.002 | — | 0.001 |
| Additive 9 | — | 0.002 | 0.001 |
| Other additives | 0.35 | 0.35 | 0.35 |
| Total Additive package (wt %) | 0.6 | 0.6 | 0.6 |
| Group I Base oil (wt %) | 39 | 39 | 39 |
| Group II Base oil (wt %) | Balance | Balance | Balance |
| Fluid KV40 | 46 | 46 | 46 |

TABLE 7

Performance Evaluation (ASTM/ISO as above)

| | Fluid | | | | | | | |
|---|---|---|---|---|---|---|---|---|
| | F | G | H | I | J | K | L | M |
| ISO Wet Stage I (%) | 86.4 | 92.4 | 84.7 | 91.9 | 79.4 | 83.1 | 93.6 | 82.8 |
| ISO Wet Stage II (%) | 75 | 82.8 | 74.7 | 85.4 | 65.9 | 66.7 | 81.5 | 66.1 |
| Time to 37 ml water | 3'53 | 3'39 | 3'26 | 21'05 | 11'12 | 6'07 | 16'27 | 8'45 |
| Time to 3 ml emulsion | 3'53 | 3'39 | 3'52 | 21'22 | 11'48 | 6'07 | 16'27 | 8'45 |
| Rust | Pass | Pass | Pass | Pass | Pass | Pass | Pass | Pass |

*ISO wet stage I (ISO 13357-1); demulsibility (ASTM D1401); and rust (ASTM D665B).

Example 3

Lubricants having varying blends of base oils and viscosities were further evaluated for performance using the additives of the present application. Lubricants are provided in Table 8 and the performance results in Table 9.

TABLE 8

Turbine lubricants including additive package and base oils.

| Additive Package (wt %) | Fluid N | O | P | Q | U |
|---|---|---|---|---|---|
| Aromatic solvent (200 ND) | 0.16 | 0.16 | 0.16 | 0.16 | 0.16 |
| Additive 4 | 0.03 | 0.03 | 0.03 | 0.03 | 0.03 |
| Additive 5 | — | — | — | — | — |
| Additive 1 | 0.04 | 0.04 | 0.04 | 0.04 | 0.04 |
| Additive 8 | — | — | — | — | — |
| Additive 3 | 0.01 | 0.01 | 0.01 | 0.015 | 0.01 |
| Additive 2 | 0.01 | 0.01 | 0.01 | 0.015 | 0.01 |
| Additive 6 | — | — | — | — | — |
| Additive 7 | 0.003 | 0.003 | 0.003 | 0.003 | 0.003 |
| Other additives | 0.35 | 0.35 | 0.35 | 0.35 | 0.35 |
| Total Additive package (wt %) | 0.6 | 0.6 | 0.6 | 0.6 | 0.6 |
| Group I Base oil | 40 | | 39 | | |
| Group II Base oil | Balance | Balance | Balance | Balance | Balance |
| Fluid KV100 | 32 | 32 | 46 | 46 | 68 |

TABLE 9

Performance Evaluation

| | ASTM/ISO TM# | Fluid N | O | P | Q | U |
|---|---|---|---|---|---|---|
| ISO Wet Stage I (%) | 13357-1 | 91.4 | 91.7 | 90.3 | 92.2 | 88.9 |
| ISO Wet Stage II (%) | 13357-1 | 83.7 | 85.2 | 85.9 | 85.9 | 82.2 |
| Time to 37 ml water | D1401 | 4'40 | 5'04 | 5'18 | 5'15 | 9'24 |
| Time to 3 ml emulsion | D1401 | 4'24 | 4'40 | 5'10 | 4'57 | 9'24 |
| Rust | D665B | Pass | Pass | Pass | Pass | Pass |

Comparative Example 1

A comparative sample was prepared and evaluated for rust performance, demulsification, and wet stage filtration as in the above Examples. The composition is provided in Table 10, and the performance in Table 11.

TABLE 10

Comparative Turbine lubricants including additive package and base oils.

| Additive Package (wt %) | Fluid C1 |
|---|---|
| Aromatic solvent (200 ND) | 0.16 |
| Additive 4 | 0.03 |
| Additive 5 | — |
| Additive 1 | — |
| Additive 8 | — |
| Additive 3 | — |
| Additive 2 | — |
| Additive 6 | — |
| Additive 7 | 0.003 |
| Other additives | 0.35 |
| Total Additive package (wt %) | 0.54 |
| Group III Base oil | Balance |

TABLE 11

Performance Evaluation

| | ASTM/ISO TM# | Fluid C1 |
|---|---|---|
| ISO Wet Stage I (%) | 13357-1 | 81.3 |
| ISO Wet Stage II (%) | 13357-1 | 65.6 |
| Time to 37 ml water | D1401 | 2'9 |
| Time to 3 ml emulsion | D1401 | 2'9 |
| Rust | D665B | Fail |

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

Unless specified otherwise, molecular weight is reported as number average molecular weight. The number average molecular weight (Mn) for any embodiment herein may be determined with a gel permeation chromatography (GPC) instrument obtained from Waters or the like instrument and the data was processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Unstabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. An additive package for a turbine lubricant to provide rust prevention and high filterability in the presence of water, the additive package comprising:

a rust-preventing mixture including an imidazoline derivative of an alkenyl succinic acid or anhydride having the structure of Formula I (Formula I)

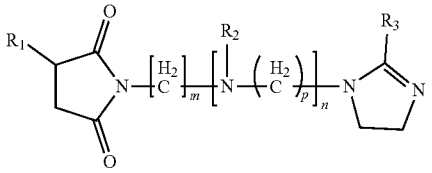

wherein R1 and R3 are, independently, a hydrocarbyl group having 10 to 19 carbons, and R2 is hydrogen, a hydrocarbyl group having 10 to 20 carbons; combined with a partial ester of a polyhydric alcohol of Formula II (Formula II)

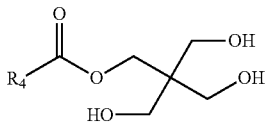

wherein R4 is a C13 to C20 saturated or unsaturated hydrocarbyl group;

an acyl sarcosine compound of Formula III (Formula III)

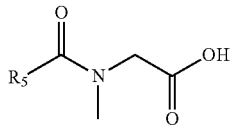

wherein R5 is a saturated or unsaturated C12 to C20 hydrocarbyl group;

a corrosion inhibiting additive of a substituted benzotriazole of Formula IV (Formula IV)

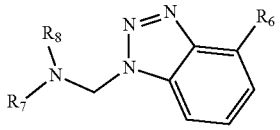

wherein R6 is a C1 to C5 hydrocarbyl group and R7 and R8 are, independently, a C1 to C10 linear or branched hydrocarbyl group;

wherein the additive package includes about 3 to about 7 weight percent of the imidazoline derivative of an alkenyl succinic acid or anhydride, about 0.5 to about 3 weight percent of the partial ester of a polyhydric alcohol, about 0.5 to about 3 weight percent of the acyl sarcosine compound, and about 3 to about 8 weight percent of the substituted benzotriazole;

a weight ratio of imidazoline provided by the rust-preventing mixture to triazole provided by the corrosion inhibitor of about 1:1 to about 2:1 with no more than 10 weight percent of the one or more imidazoline derivatives in the additive package; and when added to a turbine lubricant, the turbine lubricant with the additive package exhibits more than about 70 percent stage II filterability according to ISO 13357-1.

2. The additive package of claim 1, further including a copolymer additive having one or more polypropylene oxide derived moieties and of one or more polyethylene oxide derived moieties and having a number average molecular weight of about 3200 g/mol to about 4300 g/mol.

3. The additive package of claim 1, wherein the additive package includes about 0.02 to about 1 weight percent of the copolymer additive.

4. The additive package of claim 1, wherein the imidazoline derivative is the reaction product of an alkenyl succinic acid or anhydride and an amino-substituted imidazoline.

5. The additive package of claim 1, wherein the partial ester of a polyhydric alcohol is the reaction product of pentaerythritol and a C13 to a C20 unsaturated fatty acid.

6. The additive package of claim 1, wherein the acyl sarcosine compound is selected from sarcosine fatty acids having a C12 to C20 acyl group.

7. The additive package of claim 6, wherein the acyl sarcosine compound is selected from lauroyl sarcosine, cocyl sarcosine, oleoyl sarcosine, stearoyl sarcosine, tall oil acyl sarcosine, and mixtures thereof.

8. The additive package of claim 1, with no more than 7 weight percent of the imidazoline derivative in the additive package.

9. The additive package of claim 1, wherein the rust-preventing mixture includes about 1.5 to about 2.5 times more of the imidazoline derivative relative to the partial ester of a polyhydric alcohol and the acyl sarcosine compound combined.

10. A turbine lubricant to provide rust prevention and high filterability in the presence of water, the turbine lubricant comprising:

a base oil of lubricating viscosity selected from a Group I, Group II, or Group III oil, or blends thereof;

a first lubricant additive including a compound of Formula I (Formula I)

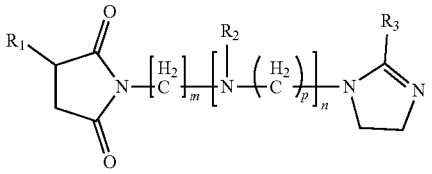

wherein R1 and R3 are, independently, a hydrocarbyl group having 10 to 19 carbons, and R2 is hydrogen, a hydrocarbyl group having 10 to 20 carbons, or a residue derived from a hydrocarbyl substituted dicarboxylic acid or anhydride thereof;

a second lubricant additive including a compound of Formula II (Formula II)

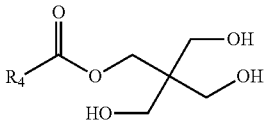

wherein R4 is a C13 to C20 saturated or unsaturated hydrocarbyl chain;

a third lubricant additive including a compound of Formula III (Formula III)

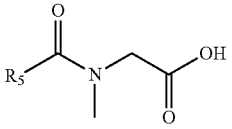

wherein R5 is a saturated or unsaturated C12 to C20 hydrocarbyl group;

a fourth lubricant additive of Formula IV (Formula IV)

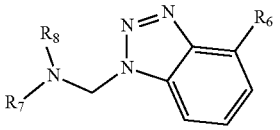

wherein R6 is a C1 to C5 hydrocarbyl group and R7 and R8 are, independently, a C1 to C10 linear or branched hydrocarbyl group;

wherein the turbine lubricant has a weight ratio of imidazoline provided by the first lubricant additive to triazole provided by the fourth lubricant additive of about 1:1 to about 2:1 with no more than 0.1 weight percent of the first lubricant additive; and wherein the turbine lubricant exhibits more than about 70 percent stage II filterability according to ISO 13357-1.

11. The turbine lubricant of claim 10, wherein the turbine lubricant includes about 0.01 to about 0.05 weight percent of the first lubricant additive, about 0.005 to about 0.1 weight percent of the second lubricant additive, about 0.005 to about 0.1 weight percent of the third lubricant additive, and about 0.01 to about 0.07 weight percent of the fourth lubricant additive.

12. The turbine lubricant of claim 11, wherein the turbine lubricant includes about 0.001 to about 0.01 weight percent of the copolymer.

13. The turbine lubricant of claim 10, with no more than 0.05 weight percent of the first lubricant additive.

14. The turbine lubricant of claim 10, wherein the turbine lubricant includes about 1.5 to about 2.5 times more of the first lubricant additive relative to the second and third lubricant additives combined.

15. The turbine lubricant of claim 10, further including a copolymer having one or more polypropylene oxide derived moieties with a total molecular weight of less than about 3400 g/mol and about 5 to about 15 percent of one or more polyethylene oxide derived moieties.

16. A turbine lubricant to provide rust prevention and high filterability in the presence of water, the turbine lubricant comprising:

a base oil of lubricating viscosity selected from a Group I, Group II, or Group III oil, or blends thereof;

a first lubricant additive including a compound of Formula I (Formula I)

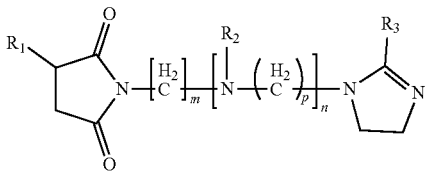

wherein R1 and R3 are, independently, a hydrocarbyl group having 10 to 19 carbons, and R2 is hydrogen, a hydrocarbyl group having 10 to 20 carbons, or a residue derived from a hydrocarbyl substituted dicarboxylic acid or anhydride thereof;

a second lubricant additive including a compound of Formula II (Formula II)

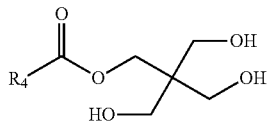

wherein R4 is a C13 to C20 saturated or unsaturated hydrocarbyl chain;

a third lubricant additive including a compound of Formula III (Formula III)

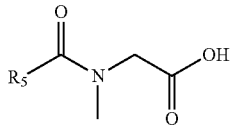

wherein R5 is a saturated or unsaturated C12 to C20 hydrocarbyl group;

a fourth lubricant additive of Formula IV (Formula IV)

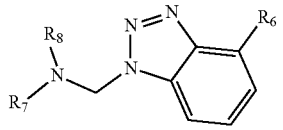

wherein R6 is a C1 to C5 hydrocarbyl group and R7 and R8 are, independently, a C1 to C10 linear or branched hydrocarbyl group;

wherein the turbine lubricant has a weight ratio of imidazoline provided by the first lubricant additive to triazole provided by the fourth lubricant additive of about 1:1 to about 2:1 with no more than 0.1 weight percent of the first lubricant additive; and wherein the base oil includes a blend of Group I and Group II base oils and has a KV40 of about 30 to about 100 cSt.

17. The turbine lubricant of claim 16, wherein the turbine lubricant includes about 0.12 to about 0.35 weight percent of the combined first, second, third, and fourth lubricant additives.

18. A turbine lubricant to provide rust prevention and high filterability in the presence of water, the turbine lubricant comprising:

a base oil of lubricating viscosity selected from a Group I, Group II, or Group III oil, or blends thereof;

a first lubricant additive including a compound of Formula I (Formula I)

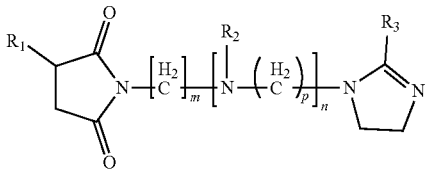

wherein R1 and R3 are, independently, a hydrocarbyl group having 10 to 19 carbons, and R2 is hydrogen, a hydrocarbyl group having 10 to 20 carbons, or a residue derived from a hydrocarbyl substituted dicarboxylic acid or anhydride thereof;

a second lubricant additive including a compound of Formula II (Formula II)

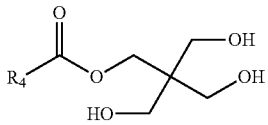

wherein R4 is a C13 to C20 saturated or unsaturated hydrocarbyl chain;

a third lubricant additive including a compound of Formula III (Formula III)

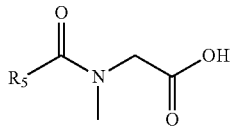

wherein R5 is a saturated or unsaturated C12 to C20 hydrocarbyl group;

a fourth lubricant additive of Formula IV (Formula IV)

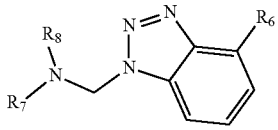

wherein R6 is a C1 to C5 hydrocarbyl group and R7 and R8 are, independently, a C1 to C10 linear or branched hydrocarbyl group;

wherein the turbine lubricant has a weight ratio of imidazoline provided by the first lubricant additive to triazole provided by the fourth lubricant additive of about 1:1 to about 2:1 with no more than 0.1 weight percent of the first lubricant additive; and wherein the turbine lubricant exhibits more than about 70 percent stage II filterability according to ISO 13357-1, a passing rust performance according to ASTM D665B, and less than about 10 minutes to 37 ml of water separation according to ASTM D1401.

* * * * *